US005187411A

United States Patent [19]

Boyd et al.

[11] Patent Number: 5,187,411

[45] Date of Patent: Feb. 16, 1993

[54] DISCHARGE LAMP LIFE AND LAMP LUMEN LIFE-EXTENDER MODULE, CIRCUITRY, AND METHODOLOGY

[75] Inventors: Dudley G. Boyd; Nian Chen, both of Memphis, Tenn.

[73] Assignee: Systems and Service International, Inc., Memphis, Tenn.

[21] Appl. No.: 738,252

[22] Filed: Jul. 30, 1991

Related U.S. Application Data

[63] Continuation-in-part of Ser. No. 402,484, Sep. 1, 1989.

[51] Int. Cl.[5] ..... H05B 41/16

[52] U.S. Cl. ..... 315/247; 315/291; 315/DIG. 7

[58] Field of Search ..... 315/247, 291, 307, DIG. 5, 315/DIG. 7

[56] References Cited

U.S. PATENT DOCUMENTS

| | | | |
|---|---|---|---|
| 3,780,347 | 12/1973 | Riesland | 315/247 |
| 3,996,495 | 12/1976 | Herman | 315/DIG. 5 |
| 4,185,233 | 1/1980 | Riesland | 315/DIG. 5 |
| 4,496,880 | 1/1985 | Luck | 315/247 |
| 4,523,131 | 6/1985 | Zansky | 315/307 |
| 4,523,795 | 6/1985 | Johnson | 315/244 |
| 4,527,099 | 7/1985 | Capewell | 315/291 |
| 4,698,554 | 10/1987 | Stupp | 315/307 |
| 4,717,863 | 1/1988 | Zeiler | 315/307 |
| 4,723,098 | 2/1988 | Grubbs | 315/291 |
| 4,727,470 | 2/1988 | Nilssen | 315/DIG. 7 |
| 4,862,040 | 8/1989 | Nilssen | 315/244 |
| 4,902,958 | 2/1990 | Cook | 315/291 |
| 4,926,097 | 5/1990 | Taek | 315/307 |
| 5,023,521 | 6/1991 | Sridharan | 315/247 |
| 5,047,691 | 9/1991 | Lesea | 315/244 |

*Primary Examiner*—Eugene R. LaRoche
*Assistant Examiner*—A. Zarabian
*Attorney, Agent, or Firm*—Richard L. Myers; Gordon L. Peterson

[57] ABSTRACT

A method of extending discharge lamp life includes slowing electrode deterioration by powering the discharge lamp so that a lamp arc current having a reduced crest factor results, either by retrofitting an existing discharge lamp system with a waveform conditioning module, by powering the discharge lamp with a ballast producing a squarewave-type waveform, or by slowing deterioration of an emissive coating on a discharge lamp electrode by such means as preheating the electrode prior to use in order to bond the emissive coating on the electrode. A discharge lamp system includes a discharge lamp and components operatively coupled to the discharge lamp for supplying a lamp arc current to the discharge lamp that has a reduced crest factor and controlled lamp watt loading, such as a ballast configured to supply a lamp arc current with a waveform that is substantially a squarewave or an existing ballast retrofitted with waveform conditioning circuitry that causes the lamp arc current to have a reduced crest factor. A module is provided for retrofit purposes in order to tune an existing ballast and discharge lamp so that the crest factor is reduced.

21 Claims, 5 Drawing Sheets

Fig. 3
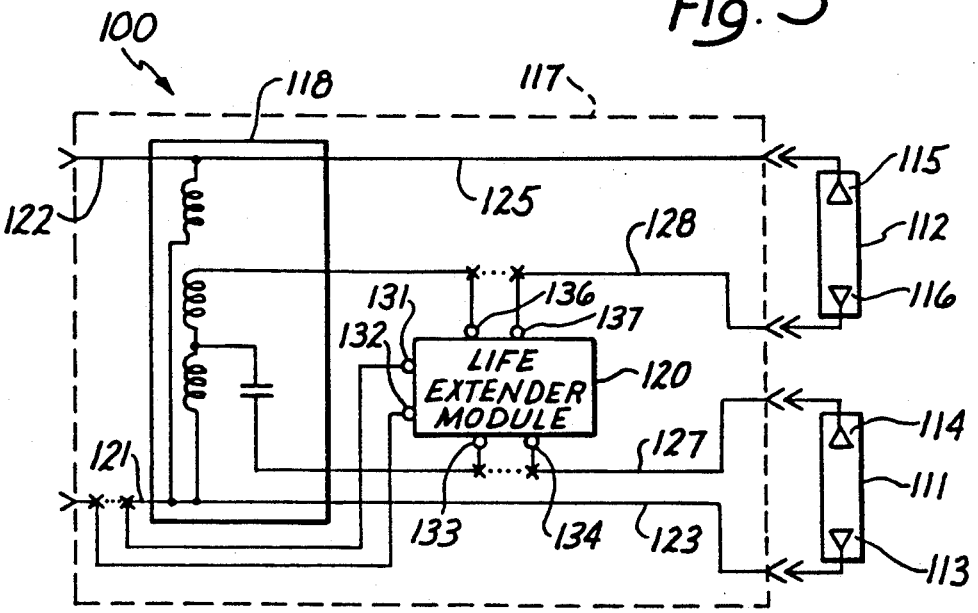
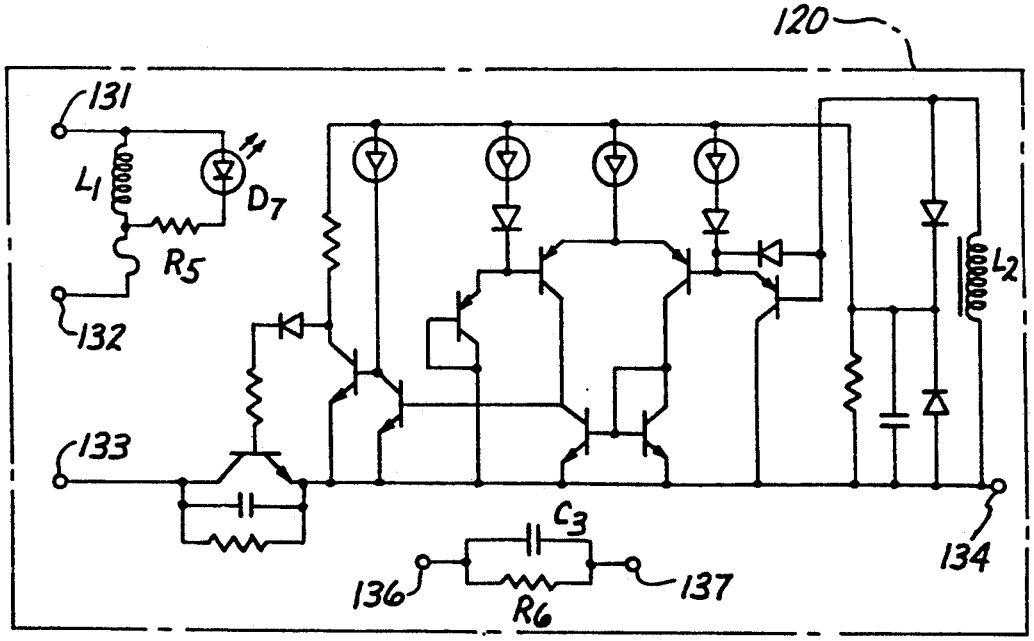
Fig. 4

Fig 8
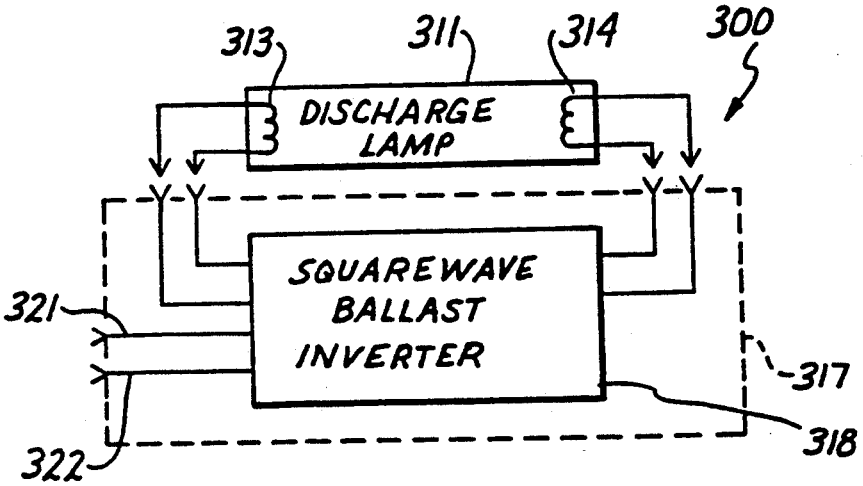
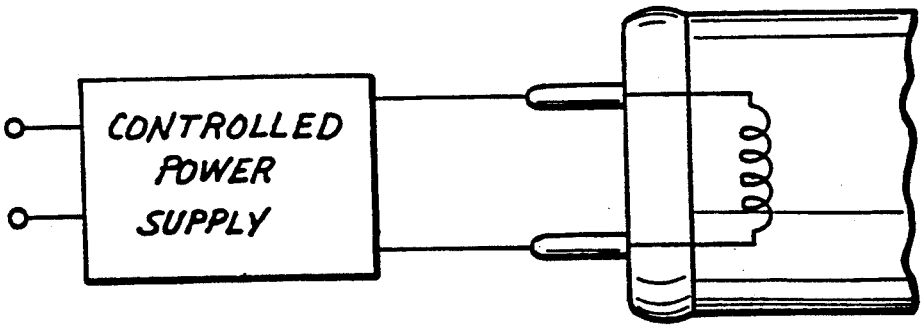
Fig. 9

DISCHARGE LAMP LIFE AND LAMP LUMEN LIFE-EXTENDER MODULE, CIRCUITRY, AND METHODOLOGY

BACKGROUND OF THE INVENTION

Cross Reference to Related Application

This is a continuation-in-part of Applicant's co-pending U.S. patent application Ser. No. 07/402,484 filed on Sep. 1, 1989.

TECHNICAL FIELD

This invention relates generally to discharge lamps, and more particularly to a module, circuitry, and methodology for extending discharge lamp life.

BACKGROUND INFORMATION

A discharge lamp uses the technique of discharging electric current through mercury vapor and other gases to produce visible and ultraviolet radiation. As that happens in the case of fluorescent lamps, the ultraviolet radiation impinges upon a fluorescent coating on the lamp, causing the fluorescent coating to emit visible light that we can use for illumination purposes with noteable efficiency. Thus, discharge lamps have come into widespread use so that the details of their construction and use demand attention.

Consider a fluorescent lamp for example. It includes a glass tube that the manufacturer coats with a fluorescent material, fills with mercury vapor, and supplies with an electrode at each end. We install the fluorescent lamp by plugging it into a lamp fixture designed to support the glass tube and supply electric current to the electrodes, the combination of the fluorescent lamp and lamp fixture sometimes being called a discharge lamp system.

The lamp fixture includes an electrical component called a ballast. The ballast transforms an external source of alternating current (such as 110-volt commercial or household current) to the voltage level necessary to operate the fluorescent lamp (i.e., high starting voltage, current-limited lower operating voltages, and any heater voltages required).

Two-terminal electrodes are used in what are called rapid-start type and pre-heat type discharge lamps (each electrode including a heater filament) and one-terminal electrodes are used in what are called instant-start discharge lamps (the electrodes being heated by the current flowing between them). Regardless of the type, the ballast when is activated the discharge lamp system is turned on, and that causes an electric potential or voltage to be impressed across the lamp. An electric current (i.e., the lamp arc current) results that arcs between the electrodes, the electrons bombarding the mercury vapor thereby producing the ultraviolet radiation.

More specifically, the ballast impresses an alternating voltage across the electrodes so that each electrode acts as a cathode during one half-cycle and as an anode during the other half-cycle. Thus, the lamp arc current alternates in direction as it flows between the two electrodes. But the electrical characteristics of the ballast and fluorescent lamps are such that a highly distorted lamp arc current waveform results.

The ballast and fluorescent lamps are usually matched so that the fluorescent lamps operate at a prescribed efficiency and operational life expectancy, resulting in a highly distorted lamp arc current waveform that maintains lamp ignition and prescribed lamp brightness as well as having a directed effect on lamp lumen life and lamp mortality. The waveform may, for example, increase somewhat slowly to a peak and then rapidly decay to zero so that the ratio of the peak value to the RMS value (i.e., the lamp arc current crest factor) is about 1.7.

The action of the lamp arc current slowly deteriorates the electrodes by depletion of the barium or other emissive electrode coating employed. We sometimes say that it causes the emissive coating to burn off, and such deterioration is affected by the lamp arc current crest factor.

In that regard, the electrodes are typically impregnated with rare earth oxides and other emissive elements that have an abundance of free electrons and low work functions. When the lamp is first installed and turned on, the electrodes heat up to operating temperature and that heats the emissive coating and causes more electrons to be emitted to facilitate the Townsend avalanche. This also bond the emissive material in place which typically occurs within one hundred hours of lamp operation. However, until that process is completed, the emissive coating is even more vulnerable to the action of the lamp arc current. In other words, it can blow or burn off all the more rapidly and deteriorate lumen and lamp life.

After the electrodes have deteriorated sufficiently and the bare tungsten electrode is exposed, the fluorescent lamp is no longer usable and must be replaced. This can result in costly maintenance in large commercial installations and is aggravated by the less frequent but regular failure of aging ballasts. Some users even replace all lamps and ballasts periodically rather than wait for the lamps and ballasts to bail. Thus, lamp maintenance can be very expensive and time consuming so that we need some way of extending discharge lamp life.

SUMMARY OF THE INVENTION

This invention extends discharge lamp life and lamp lumen life by slowing electrode deterioration. That is done according to one aspect of the invention by producing a reduced crest factor that is less than that of existing systems (i.e., less than about 1.7), either with a waveform conditioning module that is retrofitted to an existing ballast or with a ballast that produces a square-wave-type waveform, or electrode deterioration can be further slowed according to another aspect of the invention by slowing deterioration of the emissive coating on the electrode, such as by preheating the electrode before, during, or after fabrication so that the emissive elements are bonded more securely to the electrode before use. Those techniques result in discharge lamp life and lumen life increasing from two to three times normal, thereby greatly reducing the time, inconvenience, and cost of lamp maintenance.

In line with the foregoing, a discharge lamp system constructed according to the invention includes a discharge lamp and means operatively coupled to the discharge lamp for supplying a lamp arc current to the discharge lamp that has a reduced crest factor. In addition to other benefits, the reduced crest factor results in a reduced product of the in-phase voltage and current dissipated in the lamp system. According to one aspect of the invention, the means operatively coupled to the discharge lamp includes a ballast configured to supply a lamp arc current to the discharge lamp so that the lamp arc current has a waveform that is substantially a squarewave. According to another aspect, the means operatively coupled to the discharge lamp includes a ballast configured to supply lamp arc current to the discharge lamp so that the lamp arc current has a crest factor of a predetermined value (a conventional ANSI value), and waveform conditioning means operatively coupled to the ballast for causing the lamp arc current to have a crest factor less than the predetermined value.

The waveform conditioning means may include a module configured to be retrofitted to an existing ballast, and the module may employ components that combine with the ballast and discharge lamp to form a tuned waveform conditioning circuit that results in a reduced peak current and/or reduced crest factor. In addition, the module may be adapted for use with the ballast in a particular one of various types of systems, such as a rapid-start type of discharge lamp system, a pre-heat type of discharge lamp system, an instant start discharge lamp system, and/or a high intensity discharge lamp system.

The above-mentioned and other objects and features of this invention and the manner of attaining them will become apparent, and the invention itself will be best understood, by reference to the following description taken in conjunction with the accompanying illustrative drawings.

BRIEF DESCRIPTION OF THE DRAWINGS

FIG. 3 is a diagrammatic representation of an instant-start type of discharge lamp system constructed according to the invention;

FIG. 4 is a schematic circuit diagram of the waveform conditioning module used in the instant-start type of discharge lamp system;

FIG. 8 is a diagrammatic representation of a discharge lamp system constructed according to the invention that includes a squarewave producing ballast; and FIG. 9 is a diagrammatic representation of a discharge lamp electrode burn in circuit.

DESCRIPTION OF PREFERRED EMBODIMENTS

Figure 1:
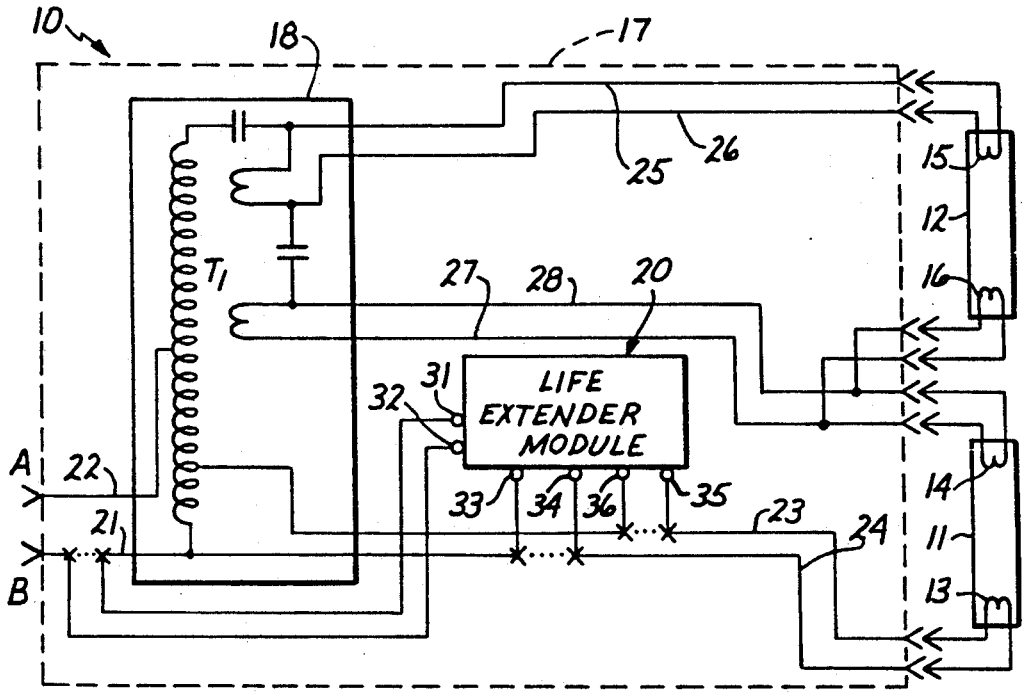
FIG. 1 of the drawings is a diagrammatic representation of a rapid-start type of discharge lamp system constructed according to the invention.

Referring now to FIG. 1, there is shown a discharge lamp system 10 constructed according to the invention. Generally, the system 10 includes one or more discharge lamps (such as the lamps 11 and 12) and means operatively coupled to the discharge lamps for supplying a lamp arc current to the discharge lamps that has a reduced crest factor. In other words, the system 10 includes means for slowing electrode deterioration by powering the discharge lamps so that a lamp arc current having a reduced crest factor results.

The crest factor can be reduced in several ways as subsequently described. But, first consider the lamps 11 and 12 and the general manner in which they are supported and powered. Although any of the various types of discharge lamps may be employed, the lamps 11 and 12 are conventional fluorescent lamps. The lamp 11 has two-terminal electrodes 13 and 14. Similarly, the lamp 12 has two-terminal electrodes 15 and 16, and the lamps 11 and 12 are plugged into a conventional fluorescent lamp fixture 17 so the electrodes are connected to a conventional ballast 18 including a transformer T1 and a ballast capacitor 19".

Crest factor reduction is accomplished in the system 10 by retrofitting the lamps 11 and 12 and the ballast 18 with a waveform conditioning module 20. The module 20 includes circuitry mounted in a suitable manner, such as on a circuit board that is encapsulated or otherwise suitably housed, for example. The module 20 is placed in the fixture 17 where it is wired into the existing fixture circuitry as subsequently described to produce the system 10.

Before modification, the fixture 17 is wired to enable first and second input lines 21 and 22 to connect the ballast 18 in a known manner to an external source of any alternating current, such as 110-VAC source (not shown), via input terminals A and B. In addition, output lines 23 and 24 connect the ballast 18 to the electrode 13 of the lamp 11, output lines 25 and 26 connect the ballast 18 to the electrode 15 of the lamp 12, and output lines 27 and 28 connect the ballast 18 to the electrodes 14 and 16 of the lamps 11 and 12, all in a known way.

The module 20 is retrofitted to the fixture 17 by breaking either one of the first and second input lines 21 and 22 and connecting terminals 31 and 32 of the module 20 at the break in the line, FIG. 1 showing a break in the input line 21 for that purpose. In addition, the output lines 23 and 24 are broken where indicated and the terminals 33–36 of the module 20 are connected at those breaks, FIG. 1 utilizing "x . . . x" to illustrate each break. Once the module 20 has been connected in that manner, the system 10 operates with a reduced crest factor that substantially lengthens the life and lumen life of the discharge lamps 11 and 12.

Of course, the precise manner in which the module is connected to the existing discharge lamp system depends on the waveform conditioning circuitry employed in the module. In that regard, any of various circuits designed according to known techniques using known components may be used within the broader inventive concepts disclosed as long as the circuit operates in conjunction with the existing discharge lamp and ballast to reduce the lamp arc current crest factor. Examples of circuitry employed in modules suitable for use with rapid-start type, pre-heat type, and instant-start type discharge lamps are described subsequently.

Figure 2:
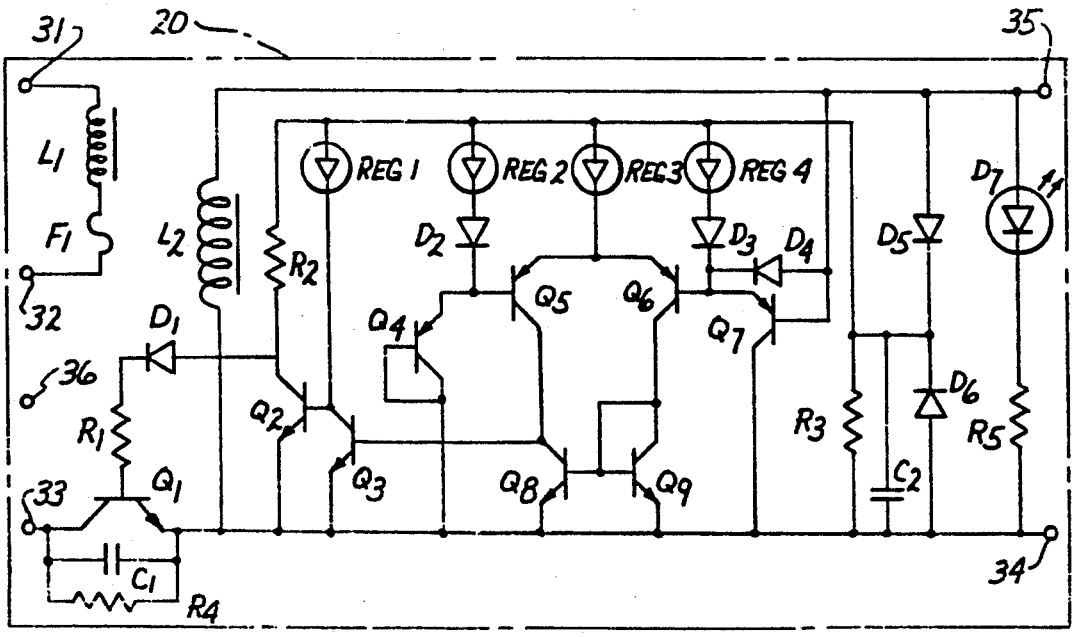
FIG. 2 is a schematic circuit diagram of the waveform conditioning circuitry employed in the rapid-start module.

Considering now FIG. 2, there is shown a schematic circuit diagram of the circuitry employed in the module 20 that operates with the ballast 18 and the lamps 11 and 12 in the rapid-start type discharge lamp system 10. Generally, the module 20 includes a tuned Inductor Controlled Waveform Conditioning Network 30 (hereinafter referred to as an ICWC Network 30), having an inductor L1 and fuse F1 connecting in series across the terminals 31 and 32. The inductor L1 and L2 being any of various known inductive devices including ones synthesized artificially by transformation or other means. Typically L1, by itself, improves the lamp arc current crest factor of most systems and therefore, is critical to any such circuit, and the values of L1 and L2 are chosen according to known circuit design techniques to operate with a semi-conductor switch, a diode, or a transistor Q1 and a capacitor C1 in a circuit that includes transistors Q2–Q9, diodes D1–D4, resistors R1–R2, and current regulators Rg1–Rg4 as subsequently described. In this particular embodiment, the ICWC Network includes the inductor L1 and the capacitor C1.

Operating power is supplied to the circuit by means of a diode bridge that includes diodes D5 and D6, filter capacitor C2 and discharge resistor R3. Voltage is supplied to that diode bridge by means of the inductor L2 which is inductively coupled to the inductor L1.

Level shifting within the ICWC Network 30 is achieved by use of a diode across capacitor C1 or triggering transistor Q1 (or any other type of switch) OFF and into full saturation in a time sequence and a duty cycle such that the time rate of change of current through the inductor L1 and the time rate of change of voltage across the capacitor C1 are harmonically related and also synchronized. Among other benefits, including monitor protection during ballast failure, level shifting across capacitor C1 provides a method for reducing the electrical burden and extending the useful life of any capacitor in the circuit during ballast failure. This is accomplished by not clamping the voltage across C1 when the ballast power factor capacitor fails in a shorted mode. Regarding Q1, it can be replaced along with its drive circuitry, within the broader inventive concepts disclosed, with a diode to produce level shifting with no variable control as is afforded with Q1 and its associated circuitry.

Proper timing to obtain the saturation and fully open limits of Q1 are accomplished by the other components Transistors Q5 and Q6 form a differential amplifier pair, driven respectively by transistors Q4 and Q7. Between terminals 35 and 34 there appears an alternating current voltage sinusoidal waveform of approximately five volts peak. The base of the transistor Q7 is referenced to the voltage on the terminal 35 and the base of the transistor Q4 is clamped to the zero voltage reference level of the terminal 34. The diodes D5 and D6, the capacitor C2, and the bleeder resistor R3 convert the sinusoidal voltage which exists across the terminals 34 and 35 into a direct current potential of approximately five volts at the node where the diode D5 and D6 are connected together (referenced to the terminal 34.)

When the voltage potential of the terminal 35 rises passing through zero referenced to the terminal 34, the transistor output pair Q8 and Q9 of the differential amplifier become offset. Then, the driver transistor Q3 is triggered on into full saturation, thus clamping the base of the output load transistor Q2 to zero potential and turning it OFF. At that time, the direct current potential at the node where the resistor R2 and the diode D1 are connected together rises to approximately $R1/(R1+R2)\times V36$ (where V36 is the voltage referenced to terminal 34), thus providing sufficient bias current to turn the transistor Q1 on into full saturation. When the potential of the terminal 35 again traverses through to its peak and back to zero, as it passes through zero, the differential comparing process reverses and the transistor Q1 becomes open, and remains open until the voltage at the terminal 35 again passes through zero and proceeds to go positive with respect to the terminal 35.

Within the framework of the discharge lamp system 10, the sinusoidal potential across the terminals 34 and 35 provides continuous and appropriate heater voltage to the electrode 13 of the lamp 11 and, by means of the diodes D5 and D6, the capacitor C2, and the resistor R3, operating voltage for the level-shifter circuit comprising the transistors Q1–Q9. The light emitting diode D7 is connected in series with the resistor R5 across the terminals 34 and 35 to provide an indication when power is on and the circuit is operational. If the circuit fails, such as by the fuse F1 blowing or the primary or secondary of the transformer T1 shorting or opening, the diode D7 goes out to facilitate troubleshooting.

Also within the framework of the discharge lamp system 10, the capacitor C1 is a constituent part of the current waveform conditioning path to the discharge lamp 11. As such it increases the net impedance counterpoising the effective negative resistance of the discharge lamp.

The overall current-waveform conditioning path to the discharge lamp includes the ICWC Network 30 previously discussed. This network not only provides the desired predetermined positive impedance, but also an appropriate reactance to properly tune for maximum efficiency. It also facilitates the transfer of energy to the discharge lamp and provides the optimum voltage and current waveforms for lamp longevity.

With the incorporation of the ICWC Network 30, the discharge lamp life and lumen life is extended beyond what it would be if the discharge lamp were connected only to a ballast. This life extension is achieved by lamp arc current crest factor reduction brought about by precise tuning of the reactance in the ICWC Network 30 creating lamp arc current waveform conditioning such that the waveform has no sharp peak excursions which would cause electrode barium depletion and loss of other emissive coating. The ICWC Network 30 overall reacts to the current surge that would normally be associated with the highly inductive ballast transformer when the lamp fires on each half cycle of the alternating current.

Therefore, the overall current-waveform conditioning path to the discharge lamp includes a ICWC Network 30 network providing not only the desired predetermined positive resistance but also an appropriate reactance to properly tune for maximum efficiency the transfer of the energy at the fundamental frequency to the discharge lamp, and also provide the optimum voltage and current waveforms at the lamp for best longevity.

Life extension is also accomplished by an improved starting cycle (for rapid start systems) that is achieved by providing through the ICWC Network 30 a controlled increase in electrode heater voltage during the starting process. Proper heating of the cathode is achieved before the ignition of the arc, thereby extending electrode life.

In addition, improved lumen life results from reduced watt-loading brought about again by controlling the voltage and arc current waveforms of the lamp to reduce sharp excursions that can result in non-elastic collisions at the phosphor surface (i.e., reduce the crest factor or ratio of the peak value to the rms value). Also, reduced beat frequency flicker is brought about by precise tuning of the reactive components to ensure symmetry of the light output waveform.

Moreover, system efficacy improves by improving the lamp power factor. Again, system tuning improves any inherent lamp voltage arc current out-of-phase condition by the transformed impedance through the ICWC Network 30. Efficacy is also increased as RFI/EMI amplitude is reduced by waveform filtering. Also by waveform filtering, voltage transient and surge protection for the lamp is obtained.

Considering now FIGS. 3 and 4, there is shown another discharge lamp system 100 constructed according to the invention, along with circuit details of a module 120 used in the system 100. The system 100 is similar in many respects to the system 10 so that only differences are described in further detail. For convenience, reference numerals designating parts of the system 100 are increased by one hundred over those designating similar parts of the system 10.

Commonly referred to as an instant-start type of discharge lamp systems, the system 110 includes one or more discharge lamps of the known type having one-terminal electrodes, (i.e., a lamp 111 having one-terminal electrodes 113 and 114 and a lamp 112 having one-terminal electrodes 115 and 116). The lamps 111 and 112 are plugged into a known type of fixture 117 where they are powered by a known type of ballast 118 having input lines 121 and 122 for coupling to an external source of alternating current, and output lines 123, 125, 127 and 128 coupled to the lamps 111 and 112.

According to the invention, a module 120 is connected to one of the input lines 119, 121, 122, 123 or 125, and to the output lines 127 and 128 of the ballast 118 by breaking the input lines where indicated by "x. . . x" and the breaks as indicated in FIG. 1. That results in a reduced crest factor in a manner similar to that utilized in the module 120 being quite similar to that employed in the module 20.

Unlike the module 20, the light emitting diode D7 and resistor R5 of the module 120 are connected across the inductor L1. However, that arrangement functions in a similar way to the arrangement employed in the module 20. That is, if the current fails, such that the fuse F1 opens, the diode D7 also will go out which will facilitate troubleshooting. In addition, the module 120 includes an optional capacitor C3 and a resistor R6 that are not included in the module 20, they being connected in the output line 128 as part of the tuned ICWC Network 130. In this embodiment, the ICWC Network 130 includes inductor L1, and capacitors C1 and C3. Because the lamp 112 in the system 100 inherently maintains an impedance characteristic independent from the lamp 111, it is therefore necessary to fine tune the arc current waveform in connection with the tuned ICWC Network 30 for maximum improvement in the lamp arc current crest factor. That fine tuning is accomplished by the capacitor C3 and the resistor R6. Of course, the precise circuitry employed in the module 120 and the precise manner in which it is connected to the ballast 118 can vary within the broader inventive concepts disclosed while still reducing the lamp arc current crest factor for lamp lumen life and lamp life extension purposes.

Figure 5:
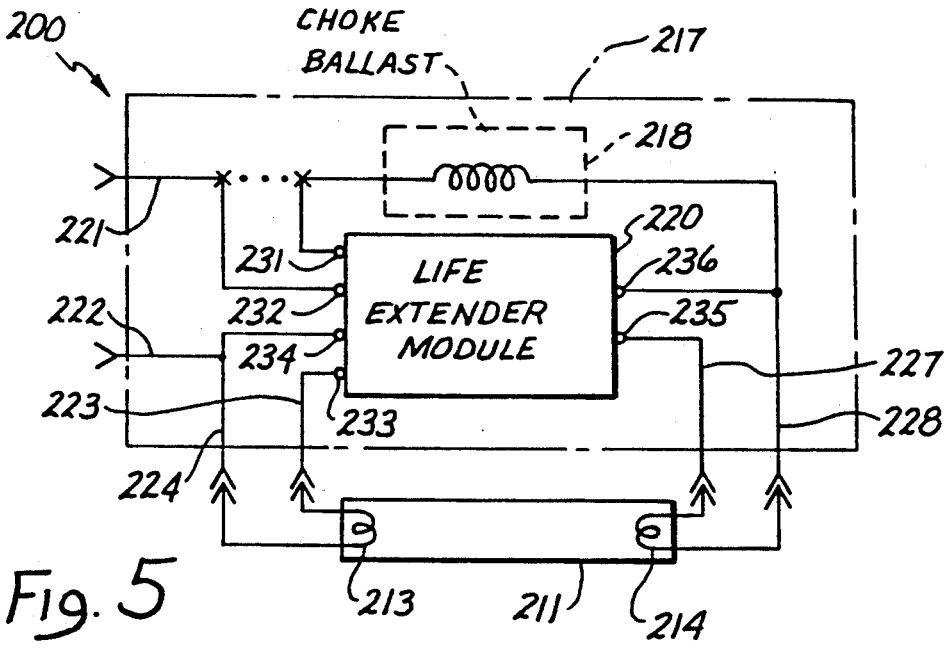
FIG. 5 is a diagrammatic representation of a pre-heat type of discharge lamp system constructed according to the invention.
Figure 6:
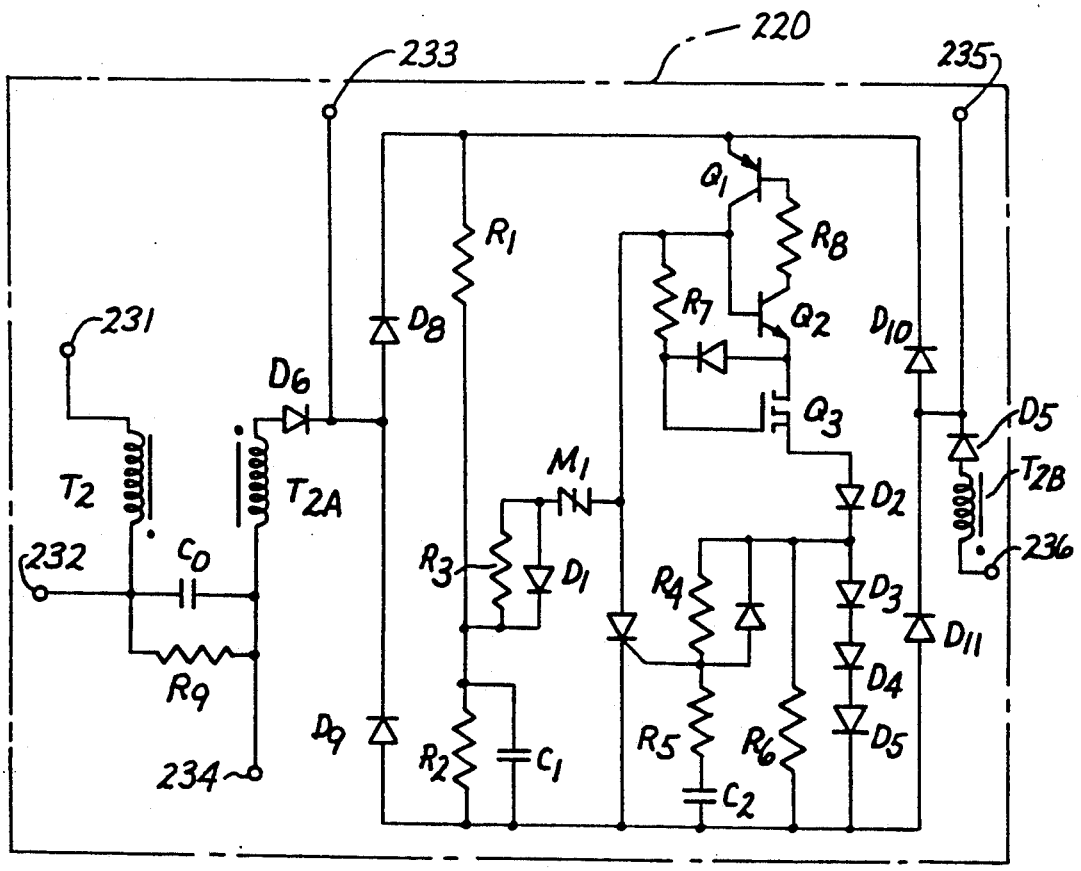
FIG. 6 is a schematic circuit diagram of the waveform conditioning module used in the pre-heat type of discharge lamp system.

Considering now FIGS. 5 and 6, there is shown yet another discharge lamp system 210 constructed according to the invention, along with circuit details of a module 220 used in the system 210. The system 210 is similar in many respects to the system 10 so that only differences are described in further detail. For convenience, reference numerals designating parts of the system 210 are increased by two hundred over those designating similar parts of the system 10.

Commonly referred to as a pre-heat type of discharge lamp system, the system 210 includes one or more discharge lamps of the known type having two-terminal electrodes, (i.e., a lamp 211 having two-terminal electrodes 213 and 214). The lamp 211 is plugged into a known type of fixture 217 where it is powered by a known type of ballast 118 having input lines 221 and 222 for coupling to an external source of alternating current, and output lines 233, 224, 235 and 228 coupled to the electrodes 213 and 214 of the lamp 111. In the embodiment of FIGS. 5 and 6, the ICWC Network 230 includes the inductor T2

Those connections result in a capacitor $C_0$, inside or outside the module 220, being connected across the input lines 221 and 222 and the other circuitry in the module 220 being connected in the output lines as shown in FIG. 6. The circuitry of the module 220 utilizes known circuit design techniques and components to tune the combination of the ballast 218 and lamp 211 in the system 210 in order to improve lamp ignition and reduce the current peak. Extended lumen life and lamp life result as explained above.

The circuitry includes a diode bridge arrangement of diodes D8–D11 maintaining a rectified A.C. potential but of varying magnitude across lines 233 and 235, and between lines 233A and 235A is applied to the input lines 221 and 222, initially an open circuit potential will result across terminals 213 and 214. Concurrently, initially a static rectified A.C. potential will exist across lines 233 and 235. That static-potential causes a current to flow through the resistor bridge R1 and R2, charging up the capacitor C1 at the rate of $I=C(dv/dt)$ to a potential V1. As the potential V1 is reached and conditioned in form by the resistor R3 and the diode D1, the breakdown potential of the silicon bilateral voltage triggering switch Ml is exceeded, thus causing it to saturate and thus provide a low impedance path for current to flow into the base of Q2 and also apply a potential to the gate of Q3.

With Q2 activated ON, Q1 is subsequently turned ON, which further enhances the turn ON of Q2. The potential ON condition, then appearing in series with Q2, and hence a low impedance path is generated between lines 233 and 235, limited by the saturation resistance of Q1, Q2, Q3 and diodes D2, D3, D4, and D5.

At that time, a low potential across and a relatively high current through the terminals 233 and 235 occurs, thus causing a potential $V2=L(di/dt)$ to appear across T2 and the ballast L consisting of the total inductance of T2 and ballast 218.

As current passes through the diodes D3, D4, and D5, a potential appears across the resistor R6, and therefore across the resistor bridge R4 and R5 and the capacitor C2. As the capacitor C2 charges up in potential, SCR Q4 is triggered ON, causing the gate potential of Q3 to be below its trigger level, turning Q3 OFF and thus forcing the potential at the base of Q2 to be below that of its emitter, turning Q2 and Q1 OFF.

With Q1, Q2 and Q3 turned OFF, very high D.C. potential V3 appears across lines 233 and 235 due to the build up at the rate of $V2=L(di/dt)$ across T2 and the ballast. That potential V2 is sufficient to cause ignition of the lamps 211, thus causing the potential difference between cathodes 213 and 214 to drop to the operating or running potential of the lamp, and also below the breakdown triggering level of the switch M1. Thus, the potential between lines 233 and 235 remains in the open condition as long as the lamp 211 operates in the run mode. Should lamp 211 not ignite, the above process will be repeated.

Primary winding T2 is mutually coupled to secondary windings T2A and T2B. The secondary rms voltage output of T2A and T2B is approximately 4-VAC. Diodes D6 and D7 are connected in series with T2A and T2B respectively which produce a pulsating D.C. heater rms voltage of 2-VDC to appear across the electrode of lamp 211 in an alternating current appearing across the lamp.

When electrode 213 is the cathode for one half cycle, it is heated which makes it more electron emissive. The anode, electrode 214, is not heated because it is not required to "send" any electrons to the other end of the lamp. Conversely, when the electrode 214 is the cathode for the alternate half cycle, it is heated and the anode, electrode 213, is not. Subsequently, diodes D6 and D7 create a pulsating cathode heater voltage that only appears when needed and, in conjunction with the inductance of T2 and capacitance of $C_0$, serves to properly tune the system. This results in a high system power factor, efficient pulse ignition, and improved lower peak lamp arc current with increased lamp lumen life, lamp mortality and reduced watt loading.

Figure 7:
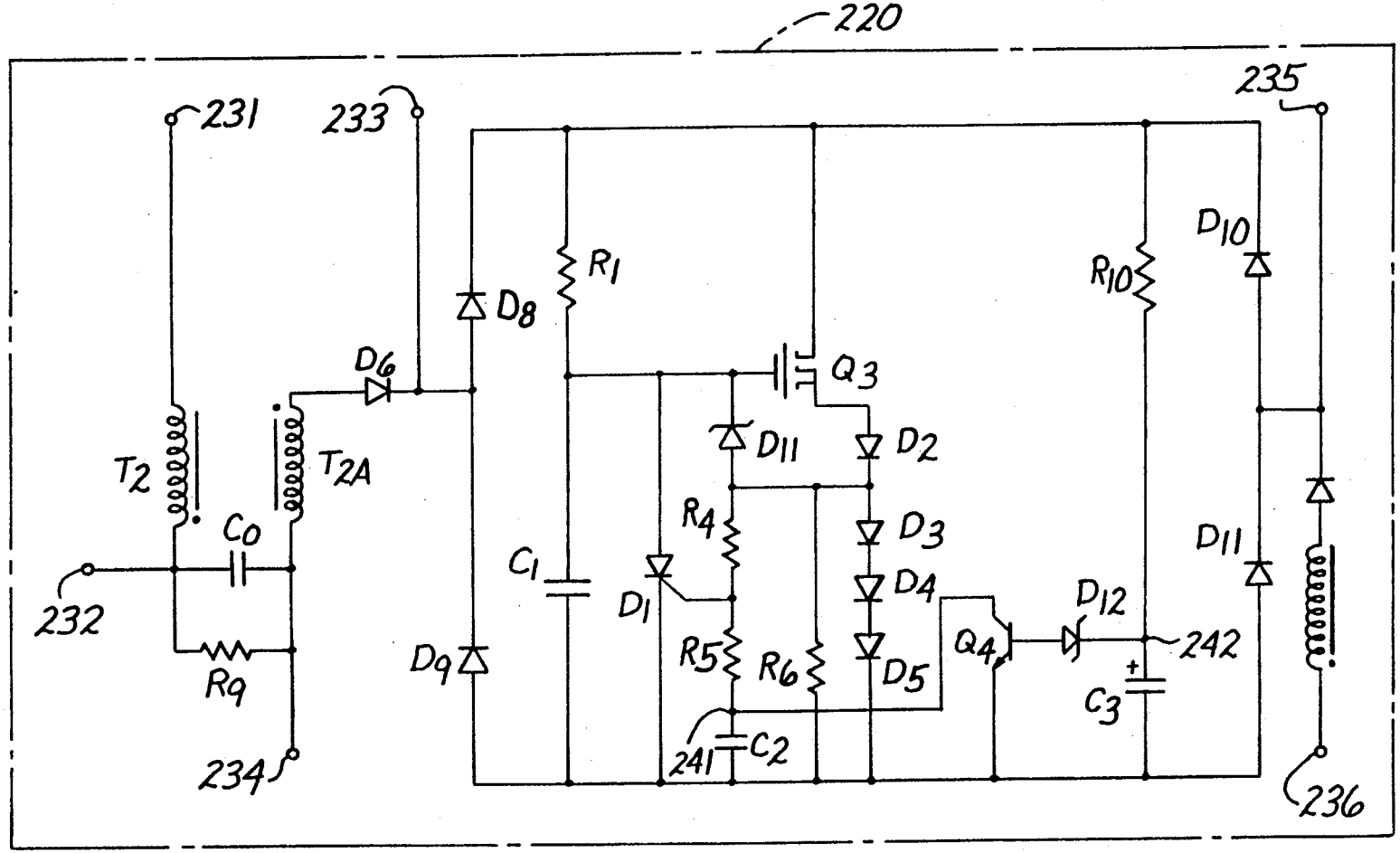
FIG. 7 is a schematic circuit diagram of a further embodiment of a waveform conditioning module adapted for use in the pre-heat type of discharge lamp system illustrated in FIG. 5.

In a further embodiment of the system 210 illustrated in FIG. 7, similar components are designated by the same reference numerals applied to the embodiment of FIG. 6. Thus the diode bridge D8–D11 maintains a rectified A.C. potential of varying magnitude between terminals 233A and 235A. The resistance R1 and capacitance C1 are connected in series between the terminals 233A and 235A. Their common conductor 240 is connected directly to the gate of FET Q3. The SCR Q1 is connected between this conductor 240 and the terminal 235A, in parallel with the series combination of a Zener diode ZD1, and the impedance bridge including R4, R5 and C2. The FET Q3 is connected in series with the parallel combination of R3 and diodes D3–D5. This current path is connected between terminals 233A and 235A.

Of particular interest to this embodiment is the RC network including R10, R6 and C3. A transistor Q4 is connected across a terminal 241 which is common to R5 and C2. A Zener diode ZD2 is connected between the gate of transistor Q4 and a terminal 242 which is common to R10, C3 and R6.

In operation, the bridge including diodes D8–D11 is initially energized providing a rectified A.C. potential of varying magnitude across terminals 233A and 235A. When the A.C. potential is initially applied to the input lines 221 and 222, an open circuit potential exists across the electrodes 213 and 214 of lamp 211. At the same time, a static rectified A.C. potential exists across the terminals 233A and 235A. The static potential causes a current to flow through the resistor R1 charging the capacitor C1 to a potential V1. As the potential V1 rises, it eventually reaches the gate threshold voltage of FET Q3. This activates Q3 producing a low impedance path between terminals 233A and 235A. The current through this path is limited by the saturation resistance of Q3 as well as the resistance of the diode series D3, D4, and D5.

At this point in time, a relatively low potential exists across the terminals 233A and 235A. However, a relatively high current flows between these terminals creating a potential V2 across the transformer T2 and the ballast 218. This potential V2 increases in accordance with the formula V2=L(di/dt) where L represents the total inductance of transformer T2 and ballast 218. The relatively low potential across terminals 233A and 235A provides a continuing voltage across R1 which is applied to the gate of FET Q3. It also causes the current to flow through the lamp cathodes where it facilitates electron emission in order to promote lamp ignition.

As the relatively large current passes through the diode series D3–D5, a potential results from the saturation resistance of the diodes. This potential is applied across resistance R3 and across the parallel impedance bridge including R4, R5 and capacitor C2. As capacitor C2 charges, SCR Q1 is triggered ON, causing the gate potential of Q3 to drop below its threshold trigger level. As a result, Q3 turns OFF.

When the FET Q3 quickly turns OFF, the high current transient di/dt generates an elevated potential across the lamp. This potential increases in accordance with the following formula:

$$V_{lamp}=V_{line}+L(di/dt)$$

where L represents the total inductance of transformer T2 and ballast 218. This transient will typically be sufficient to cause ignition of the lamp 211 If the lamp 211 ignites, the potential difference across electrode 213 and 214 will reduced to the operating potential of the lamp. In addition, the current flowing through the parasitic output capacitance of the FET Q3 will cause a continuing potential to occur across capacitor C2. This continuing potential will maintain the SCR Q1 in a conducting state thereby preventing FET Q3 from retriggering.

In the event the lamp 211 does not ignite within the time predetermined by the RC network R10, R6 and C3, a charge will continue to rise on the capacitor C3 until it reaches the breakdown voltage of ZD2. When the diode ZD2 collapses, capacitor C2 will discharge through transistor Q4. The absence of charge on capacitor C2 will cause SCR Q1 to turn OFF and the cycle will repeat until the lamp 211 ignites.

It will be apparent to those skilled in the art that the embodiments of FIG. 6 and FIG. 7 are somewhat similar. Nevertheless, they tend to differ to some extent in their performance characteristics. For example, the embodiment of FIG. 7 tends to have better performance characteristics in cold temperatures. During the winter months, the impedance of a normal fluorescent lamp tends to rise as the temperature drops. This tends to make it difficult for the module 220 of FIG. 6 to restrike if the lamp does not fire the first time. The embodiment of FIG. 7 seems to be less susceptible to this characteristic.

The embodiment of FIG. 7 also seems to operate with a greater variety of lamp. For example, if a rapid-start lamp is installed in a fixture designed for a preheat lamp, as is often the case, the circuit of FIG. 7 seems to be more capable of accommodating this dissimilarity of lamps.

Consider now FIGS. 8 and 8*a* where there is shown still another discharge lamp System 310 constructed according to the present invention. The System 310 is similar in some respects to the system 10 illustrated in FIG. 1 so that only differences are described in further detail. For convenience, numerals designating parts of System 310 are increased by 300 over those designating similar parts of the System 10.

Unlike the System 10 of FIG. 1, the System 300 of FIG. 8 and 8*a* does not include a module that has been retrofitted to an existing ballast. Instead it integrates both the ballast and the technology of the module 20 previously discussed. In this integrated embodiment, the lamp arc current also has a square-type waveform such as that previously described with reference to System 10. Thus, the crest factor is well below the standard of 1.7 set by the American National Standards Institude, and approaches unity. The square-type waveform compares favorably to an absolute squarewave even though it may be somewhat rounded or sloped. The result is substantially the same, a crest factor which is less than 1.7, typically 1.35 and as low as 1.25. The integrated embodiment of FIG. 8*a* is similar to the embodiment of FIG. 1 except for the connection of circuitry associated with the box 320. This circuitry is the same as that discussed with respect to the module 20 illustrated in FIG. 2, with one exception. The inductor L2 is eliminated. In the integrated embodiment of FIG. 8*a*, the terminal 335 is connected directly to the heater winding 327. This winding 327 functions as the inductor L2 illustrated in FIG. 2. This integrated embodiment provides the capacitor C1 with a direct connection through the terminal 335 to the heater winding 327. The inductor L1 previously discussed with reference to FIG. 2, can be connected to the input terminal 321 and/or the input terminal 322 at the points indicated by "X . . . X" in FIG. 8*a*. The circuitry in the box 320 is also integrated into the ballast at terminals 333, 334 and 335 as illustrated in FIG. 8*a*.

Concerning deterioration of the emissive coating on the electrodes, that is slowed as mentioned above by preheating the electrode before, during, or after fabrication so that the emissive elements are bonded more securely to the electrode before use. That may be done in case of filament-type electrodes (filaments) by supplying power to the filaments for a period of time with no arc current flowing (i.e., before use), preferably at any voltage that specifically causes the electron emissive material on the lamp electrode to bond more readily to the filaments or electrodes. FIG. 8 is a diagrammatic representation of a discharge lamp electrode burn-in circuit.

The barium, rare earth oxides, and other elements that are typically packed onto the fluorescent lamp electrodes in a powdery form are susceptible to being "blown off" or eroded by lamp ignition and the lamp arc current, particularly during initial use of the lamp. The electrode "burn-in" method fuses the powdery elements to the electrode, making them less susceptible to being eroded by the starting cycle or the lamp arc current and subsequently, improved lamp lumen life and lamp mortality.

Although exemplary embodiments of the invention have been shown and described, many changes, modification, and substitutions may be made by one having ordinary skill in the art without necessarily departing from the spirit and scope of the invention. For example, one could combine conventional ballast circuitry and waveform conditioning means in what might be called a tuned ballast (instead of having waveform conditioning means added to an existing ballast), and such an arrangement is intended to fall within the scope of the claims.

What is claimed is:

1. A discharge lamp system comprising:

a ballast including a ballast capacitor, said ballast being adapted to be coupled to a discharge lamp for supplying a lamp arc current having a predetermined crest factor to the discharge lamp; and a waveform conditioning module including a capacitor, being coupled to the ballast in series with the ballast capacitor, said waveform conditioning module causing the lamp arc current to have a crest factor less than the predetermined value; and the wave form conditionig module including an ICWC Network.

2. A system described in claim 1 wherein the capacitor of the waveform conditioning module is coupled to the ballast between the ballast and the lamp.

3. A discharge lamp system comprising:

a ballast including a primary coil and a ballast capacitor, said ballast being adapted to be coupled to a discharge lamp for supplying to the discharge lamp a lamp arc current having a predetermined crest factor;

a waveform conditioning module including a capacitor and being coupled to the ballast in series with the ballast capacitor;

a tuned ICWC Network included in the ballast and coupled to the primary coil of the ballast; and said waveform conditioning module causing the lamp arc current to have a crest factor less than the predetermined value.

4. A discharge lamp system comprising:

a ballast including a primary coil and a ballast capacitor, said ballast being adapted to be coupled to a discharge lamp for supplying to the discharge lamp a lamp arc current having a crest factor with a predetermined value;

a waveform conditioning module including a capacitor and being coupled to the ballast in series with the ballast capacitor;

means forming an inductive path in the module for conducting a particular current;

inductance means included in the path and responsive to the flow of the particular current to store energy;

electronic switch means disposed in the path and having a first state providing an open circuit in the path and a second state providing a closed circuit in the path;

means included in the module and having a delayed response to the particular current in the path for placing the switch means in the first state to block the flow of the particular current to the inductance means;

means included in the module and responsive to the opening of the path for discharging to the lamp the energy stored in the inductance means, the discharged energy providing a voltage transcient for starting the lamp; and said waveform conditioning module causing the lamp arc current to have a crest factor less than the predetermined value.

5. The system recited in claim 4 further comprising:

means responsive to ignition of the lamp for maintaining the switch means in the first state; and means responsive to failure of the lamp to ignite for placing the switch means in the second state.

6. The system recited in claim 3 wherein the ICWC Network includes:

an inductance coupled to the ballast;

a capacitance tuned to the inductance; and means for alternatively switching the capacitance into a series relationship with the inductance to increase the crest factor of the lamp arc current.

7. The system recited in claim 6 wherein the ballast further comprises a primary coil of a transformer and the inductance comprises a secondary coil of the transformer.

8. The system recited in claim 3 wherein:

the lamp includes at least one electrode;

prior to lamp ignition, the system provides a heater voltage to the electrode; and the ICWC Network includes means for increasing the electrode heater voltage to extend electrode life.

9. The system recited in claim 3 wherein the ICWC Network includes means for reducing sharp excursions in the lamp arc current in order to reduce the current crest factor and extend the lumen life of the lamp.

10. The system recited in claim 3 wherein the ICWC Network includes means for reducing beat frequency flicker to insure symmetry in the light output waveform.

11. The system recited in claim 3 and having a lamp arc voltage with an undesirable out-of-phase relationship with the lamp arc current, whereas the ICWC Network includes an impedance tunable to improve the out-of-phase relationship and increase the efficiency of the discharge lamp.

12. A pre-heat type of discharge lamp system including:

a discharge lamp;

a choke ballast coupled to the lamp for supplying a lamp arc current having a crest factor of a predetermined value;

waveform conditioning means including an ICWC Network coupled between the choke ballast and the lamp, the ICWC Network including a tuned circuit for decreasing the crest factor of the lamp arc current below the predetermined value.

13. The system recited in claim 12 wherein the ICWC Network further comprises means for reducing the peak value of the lamp arc current to provide extended lamp life and lamp lumen life.

14. The system recited in claim 12 wherein the ICWC Network further comprises diode bridge means for maintaining a rectified AC potential of variable magnitude across the lamp.

15. The system recited in claim 12 wherein the lamp includes two heater electrodes and is powered by an AC signal having two half cycles, the ICWC Network further comprising means for heating each of the electrodes in alternate half cycles of the AC signal.

16. The system recited in claim 14 further comprising an RC circuit including a first resistance, a second resistance, and a capacitance; and a diode bridge coupled through a Zener diode to a terminal which is common to the first resistance, the second resistance and the capacitance of the RC circuit.

17. The system recited in claim 12 wherein the waveform conditioning module includes:

a diode bridge providing a rectified potential between a first terminal and a second terminal;

switch means providing a controlled current path between the first and second terminals;

means responsive to a potential across the first and second terminal for placing the switch in a closed state thereby creating a high current transient for igniting the lamp; and means responsive to the ignition of the lamp for maintaining the switch means in the closed state;

18. The system recited in claim 17 wherein the switch means comprises:

a capacitance coupled between the first and second terminals, the capacitance having a charge which increases over time; and a transistor responsive to a charge on the capacitor to switch to the closed state thereby creating the high current transient.

19. An instant-start discharge lamp system, comprising:

a ballast including a primary coil and a ballast capacitor, said ballast being adapted to be coupled to an instant start discharge lamp having single terminal electrodes, for supplying to the discharge lamp a lamp arc current having a predetermined crest factor;

a waveform conditioning module including a conditioning capacitor coupled to the ballast in series with the ballast capacitor; and an ICWC Network included in the module and coupled to the primary coil of the ballast, the ICWC Network causing the lamp arc current to have a crest factor less than the predetermined value.

20. The lamp system recited in claim 19 wherein the ICWC Network further comprises:

an inductor connected in series with a fuse across the primary coil; and means coupled to the inductor for providing an indication of current failure.

21. The system recited in claim 20 wherein the indicator means includes a diode which provides a visual indication of current failure.

* * * * *